US007165481B2

(12) United States Patent
Kikuchi

(10) Patent No.: US 7,165,481 B2
(45) Date of Patent: Jan. 23, 2007

(54) SCREWDRIVER

(75) Inventor: Noriaki Kikuchi, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/411,818

(22) Filed: Apr. 27, 2006

(65) Prior Publication Data

US 2006/0243104 A1 Nov. 2, 2006

(30) Foreign Application Priority Data

Apr. 28, 2005 (JP) ..... P2005-130716

(51) Int. Cl.

| | |
|---|---|
| ***B25B 23/06*** | (2006.01) |
| ***B25B 17/00*** | (2006.01) |
| ***B25B 13/00*** | (2006.01) |
| *B25C 5/02* | (2006.01) |
| *B25C 5/06* | (2006.01) |
| *B25C 5/16* | (2006.01) |
| *B25F 7/00* | (2006.01) |

(52) U.S. Cl. ..... 81/434; 81/57.37; 81/57.44; 227/136

(58) Field of Classification Search ..... 81/434, 81/57.37, 57.42, 57.44; 227/136, 15, 18; 72/391.6; 29/525.06

See application file for complete search history.

(56) References Cited

U.S. PATENT DOCUMENTS 4,428,261 A * 1/1984 Takatsu et al. ..... 81/434
5,027,679 A * 7/1991 Kawashima et al. ..... 81/434
5,402,695 A * 4/1995 Hornung ..... 81/434
5,671,645 A * 9/1997 Murayama et al. ..... 81/434
6,138,536 A * 10/2000 Chen ..... 81/434
6,186,385 B1 * 2/2001 Huang ..... 227/119
6,296,166 B1 * 10/2001 Huang ..... 227/119

FOREIGN PATENT DOCUMENTS

| | | |
|---|---|---|
| JP | 2550301 | 6/1997 |
| JP | 2900982 | 3/1999 |

* cited by examiner

*Primary Examiner*—Lee D. Wilson
*Assistant Examiner*—Alvin J. Grant
(74) *Attorney, Agent, or Firm*—Mattingly, Stanger, Malur & Brundidge, P.C.

(57) ABSTRACT

A screwdriver includes a driver portion, a slider case having a guide slot, a slider (7), comprising parts (7A) and (7B) reciprocating, in the slider case, an arm portion comprising shaft arm (16) and clutch arm that is supported and rotates in the slider (7), engaged with the guide slot of the slider case, and oscillates in accordance with the reciprocation of the slider, and a cylindrical drum that is supported and rotates in the slider, has two flanges (11*b*) and (11*c*) engaged with a screw chain belt and a ratchet (11*e*) engaged with the arm portion, and intermittently delivers the screw chain belt in accordance with the oscillation of the arm portion. The ratchet (11*e*) of the drum (11) is formed on an inner surface of the flange (11*b*).

6 Claims, 8 Drawing Sheets

SCREWDRIVER

BACKGROUND OF THE INVENTION

1. Technical Field

The present invention relates to a screwdriver that sequentially launches and drives screws held through a screw chain belt into a part to be threaded-fastened by delivering the screw chain belt by one pitch as the screw is driven.

2. Description of Related Art

Such type of screwdriver is used to fix a gypsum board to a base material such as wood or steel using screws and has been proposed in the related art (for example, see Japanese Patent No. 2900982 and Japanese Registered Utility Model No. 2,550,301).

A conventional screwdriver will be described below with reference to the accompanying drawings.

FIG. 9 is a side view of a conventional screwdriver, FIG. 10 is an exploded perspective view of a screw-delivering mechanism of the screwdriver, FIG. 11 is an exploded perspective view of a slider of the screwdriver, FIG. 12 is a bottom cross-sectional view of a clutch mechanism of the screwdriver, and FIG. 13 is a partial cross-sectional view illustrating threaded fastening using the screwdriver.

Reference numeral 2 indicates a housing in the screwdriver 1 shown in FIG. 9. The housing 2 accommodates a motor (not shown) as a driving source and an output shaft 3 rotated by the motor (see FIG. 13) therein, and a bit 4 is fitted at the end of the output shaft 3 as shown in FIG. 13. A driver portion consists of the housing 2, the motor and the output shaft 3 accommodated in the housing, and the bit 4 fitted at the end of the output shaft 3.

As shown in FIG. 9, a rectangular barrel-shaped slider case 5 is fixed to the front of the housing 2 and an L-shaped guide slot 6 is formed on one side of the slider case 5. A slider 7 is fitted and slides in the slider case 5, and is pushed in one direction (toward the left side in FIG. 9) during normal conditions by a coil spring 8 compressed between the slider and the slider case 5.

The slider 7, as shown in FIGS. 10 and 11, is formed by assembling left and right parts 7A and 7B and an arc guide slot 7*a* is formed on the side of the part 7A. A screw-delivering mechanism is mounted in the slider 7, which includes a shaft arm 19, a drum 11, a clutch 20, and a coil spring 10.

The shaft arm 19 has a shaft-like guide arm 19*a* and a lever 19*b* perpendicularly fixed to the guide arm 19*a*. The shaft arm 19 is supported in the slider 7 by inserting a shaft 21 into a hole 19*c* formed through the lever 19*b* and is capable of rotating. The guide arm 19*a* of the shaft arm 19 is inserted into a guide slot 7*a* formed through the part 7A of the slider 7. An end of the guide arm protrudes from the slider 7 (left part 7A) and is fitted into the guide slot 6 formed through the slider case 5. A U-shaped engaging groove 19*d* is formed at the end of the lever 19*b* of the shaft arm 19.

The drum 11 is a cylindrical part that is supported by a shaft and capable of rotating in the slider 7 and two disc-shaped flanges 11*b* and 11*c* are fitted into a shaft 11*a* of the drum 11 at an axially predetermined space. A plurality of teeth to be engaged with a screw chain belt 100 (shown in FIG. 9) is formed on the circumference of each of the flanges 11*b* and 11*c*.

A ratchet 11*e* is formed on the outside of the flange 11*b* of the drum 11 and a ring-shaped clutch 20 engaged with the ratchet 11*e* is supported by the rotating shaft 11*a* of the drum 11 and capable of rotating. The clutch 20 is pushed toward the drum 11 by the coil spring 10 between the clutch and the slider 7 (left part 11A). As a result, pressed against the ratchet 10*e* of the flange 11*b*. A pin 20*a* protrudes from the outside of the clutch 20 and is engaged with the engaging groove 19*d* formed at the lever 19*b* of the shaft arm 19.

Operation of the screwdriver 1 having the above configuration will be described below.

As shown in FIG. 9, in fixing a gypsum board W2 to a base material W1 such as wood or steel by using screws, when the screwdriver 1 is pressed against the gypsum board W2, the slider 7 is pushed into the slider case 5 (downward in FIG. 13) against a reacting force of the coil spring 8 and the shaft arm 19 rotates about the shaft 21. In other words, as the guide arm 19*a* of the shaft arm 19 supported in the slider 7 slides along the guide slot 6, the lever 19*b* rotates about the shaft at a predetermined angle. As a result, the clutch 20 also rotates in the same direction at the same angle by the rotation of the lever 19*b*. As the clutch 20 rotates, the drum 11 rotates due to the ratchet 11*e* engaged with the clutch 20, and the screw chain belt 100 engaged with both of the flanges 11*b* and 11*c* of the drum 11 is intermittently delivered from the slider case to predetermined distance. As a result, the screws 101 held through the screw chain belt 100 are delivered one-by-one.

When the screws 101 are delivered as described above, a screw 101 positioned on an axis of the bit 4 of the driver is launched from the screw chain belt 100 and driven into the gypsum board W2 by the bit 4. The screw 101 fastens the gypsum board W2 to the base material W1, and is driven by the bit 4, which is rotated by a motor (not shown).

As the screwdriver 1 is detached from the gypsum board W2, the slider 7 returns to the initial position and slides in the slider case 5 by the reacting force of the coil spring 8. The clutch 20 reverses as the slider 7 slides, but the reverse rotation is not transmitted to the drum 11. Therefore, the screw chain belt 100 and the screws 101 are not delivered.

By repetition of this operation, the screw chain belt 100 is delivered by one pitch and the screws 101 held by the screw chain belt 100 are sequentially delivered into the slider one-by-one, which allows the gypsum board W2 to be fastened to the base material W1 by several screws 101.

SUMMARY OF INVENTION

However, in the above-mentioned threaded fastening, as shown in FIG. 13, particles such as gypsum particles of the gypsum board W2 or fragments of the screw chain belt 100 permeate into the screw-delivering mechanism of the screwdriver 1. In particular, in case the particles are caught between the ratchet 11*e* of the drum 11 and the clutch 20, the operation of the screw-delivering mechanism becomes unstable and the screw 101 may not be normally launched.

Therefore, a user has had to regularly blow compressed air or spray lubricant into the screw-delivering mechanism using a compressor or a lubricating spray in order to remove the remaining particles and clean the screw-delivering mechanism.

In the conventional screwdriver shown in FIGS. 9 to 13, since the ratchet 11*e* of the drum 11 is formed on the surface of the flange 11*b* facing the inside of the slider, the clutch 20 is engaged with the ratchet 11*e* between the flange 11*b* and the inside of the slider 7.

A space between the flange 11*b* of the drum 11 and the inside of the slider 7 is very small because of the compact screw-delivering mechanism. Therefore, it is difficult to completely remove the remaining particles between the ratchet 11*e* and the clutch 20 in the narrow space by cleaning. As a result, it is difficult to constantly secure the operational stability of the screw-delivering mechanism because particles inevitably remain in the screw-delivering mechanism.

Considering the above problems, an object of the invention is to provide a screwdriver high operational stability by easily and securely removing particles remaining in a screw-delivering mechanism.

In order to achieve the above-mentioned object, according to a first aspect of the invention, a screwdriver includes: a driver portion that includes a motor, an output shaft rotated by the motor, a housing accommodating the motor and the output shaft, and a bit fitted at the end of the output shaft; a barrel-shaped slider case which has a guide slot and is fixed to the housing and in which the bit is inserted; a slider that is supported and reciprocates in the slider case; an arm portion that is supported and rotates in the slider, engaged with the guide slot of the slider case, and oscillates in accordance with the reciprocation of the slider; and a cylindrical drum that is supported and rotates in the slider, has two flanges engaged with a screw chain belt and a ratchet engaged with the arm portion, and intermittently delivers the screw chain belt in accordance with the oscillation of the arm portion. In this case, the ratchet of the drum is formed on an inner surface of the flange facing the other flange.

According to a second aspect of the invention, in the first aspect of the invention, the arm portion includes: a shaft arm that has a shaft supported in the slider and rotating about another axis parallel to a rotating shaft of the drum, and a guide arm extending from the shaft beyond the guide slot of the slider and having one end fitted in the guide slot; a clutch arm that extends from the shaft of the shaft arm to the drum and has one end engaged with the ratchet and the other end fitted to the shaft of the shaft arm so as not to rotate relative to the shaft such that the one end is disengaged from the ratchet, and a first elastic member that pushes the clutch arm to engage the one end of clutch arm and the ratchet with each other.

According to a third aspect of the invention, in the second aspect of the invention, the first elastic member is a coil spring in which the shaft of the shaft arm is inserted, has one end locked to the guide arm of the shaft arm and the other end locked to the slider, and presses the guide arm of the shaft arm to be held in the guide slot of the slider.

According to a fourth aspect of the invention, in the second or third aspect of the invention, the slider further includes: a stopper plate that extends from the shaft of the shaft arm to the ratchet of the drum, has one end engaged with the ratchet and the other end connected to the shaft such that the one end is disengaged from the ratchet; a second elastic member for pushing the stopper plate in a direction in which the one end is engaged with the ratchet; and a third elastic member for supporting the shaft arm so that the shaft arm reciprocates in an axial direction of the slide, and for pushing the shaft arm toward one side in the axial direction. When the shaft arm moves in the axial direction against a reacting force of the third elastic member, the clutch arm and the stopper plate move in the same direction to be disengaged from the ratchet.

According to a fifth aspect of the invention, in the fourth aspect of the invention, one coil spring in which the shaft arm is inserted functions as both the first and third elastic members.

According to a sixth aspect of the invention, in one of the first to fourth aspects of the invention, the drum is formed by assembling two separated parts, the flanges are provided to the separated parts, respectively. Further, the ratchet is formed on an inner surface of one flange facing the other flange.

According to the first aspect of the invention, since the distance between two flanges of a drum is determined to correspond to the width of a screw chain belt, a relatively wide space is defined between the flanges. The most vulnerable portion to particles in a screwdriver, that is, an engaging surface of a ratchet and an arm portion is defined in the wide space. For this reason, particles are not easily caught between the ratchet and the arm portion, or even if particles are caught. Accordingly, the particles are easily removed by cleaning, thus the screwdriver can stably operate.

According to the second aspect of the invention, since the engaging part of the arm portion with the ratchet is a clutch arm extending from a shaft that is spaced from the drum to the ratchet, the entire ratchet is not engaged with the clutch arm and a part of the ratchet remains not engaged. Therefore, even if particles are caught between the ratchet and the clutch arm, the particles are promptly discharged outside as the clutch arm is disengaged with the ratchet. As a result, the screwdriver can constantly operate regardless of particles and have improved operational stability.

According to the third aspect of the invention, although the arm portion does not smoothly operate due to particles in a screw-delivering mechanism, a guide arm has been pushed by a first elastic member to be held in a guide slot of a slider, therefore, the guide arm is constantly held in the guide slot while the slider reciprocates. Accordingly, since screw delivering does not stop due to separation of the guide arm from the guide slot, the screwdriver can have high operational stability.

According to the fourth aspect of the invention, when a shaft arm is pressed against the reacting force of a third elastic member, the clutch arm and a stopper plate and are disengaged from the ratchet. As a result, the drum is capable of rotating in both the delivering direction of a screw chain belt and the opposite direction. Therefore, when excessively delivered, the screw chain belt can be delivered in the opposite direction, which allows versatile operation of the screwdriver.

According to the fifth aspect of the invention, in the screwdriver, since a coil spring has two functions, the number of parts and cost can be reduced.

According to the sixth aspect of the invention, the drum can be manufactured in a complicated structure having the flange provided with the ratchet on its surface facing the other flange by forming two separated parts and assembling them.

DESCRIPTION OF THE EMBODIMENTS

A preferred embodiment according to the invention will be described below with reference to the accompanying drawings.

Figure 1:
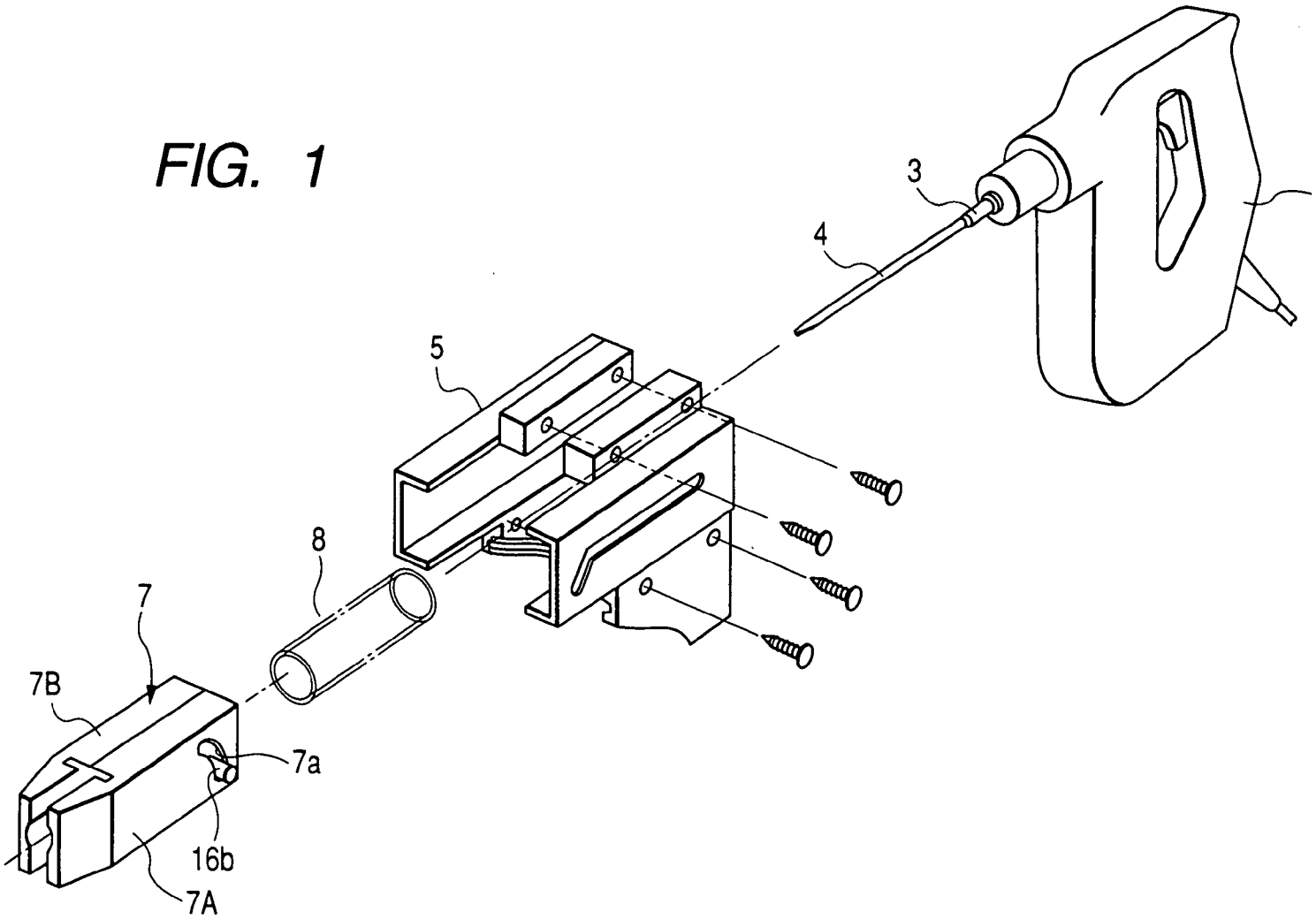
FIG. 1 is an exploded perspective view of a screwdriver according to the invention.
Figure 2:
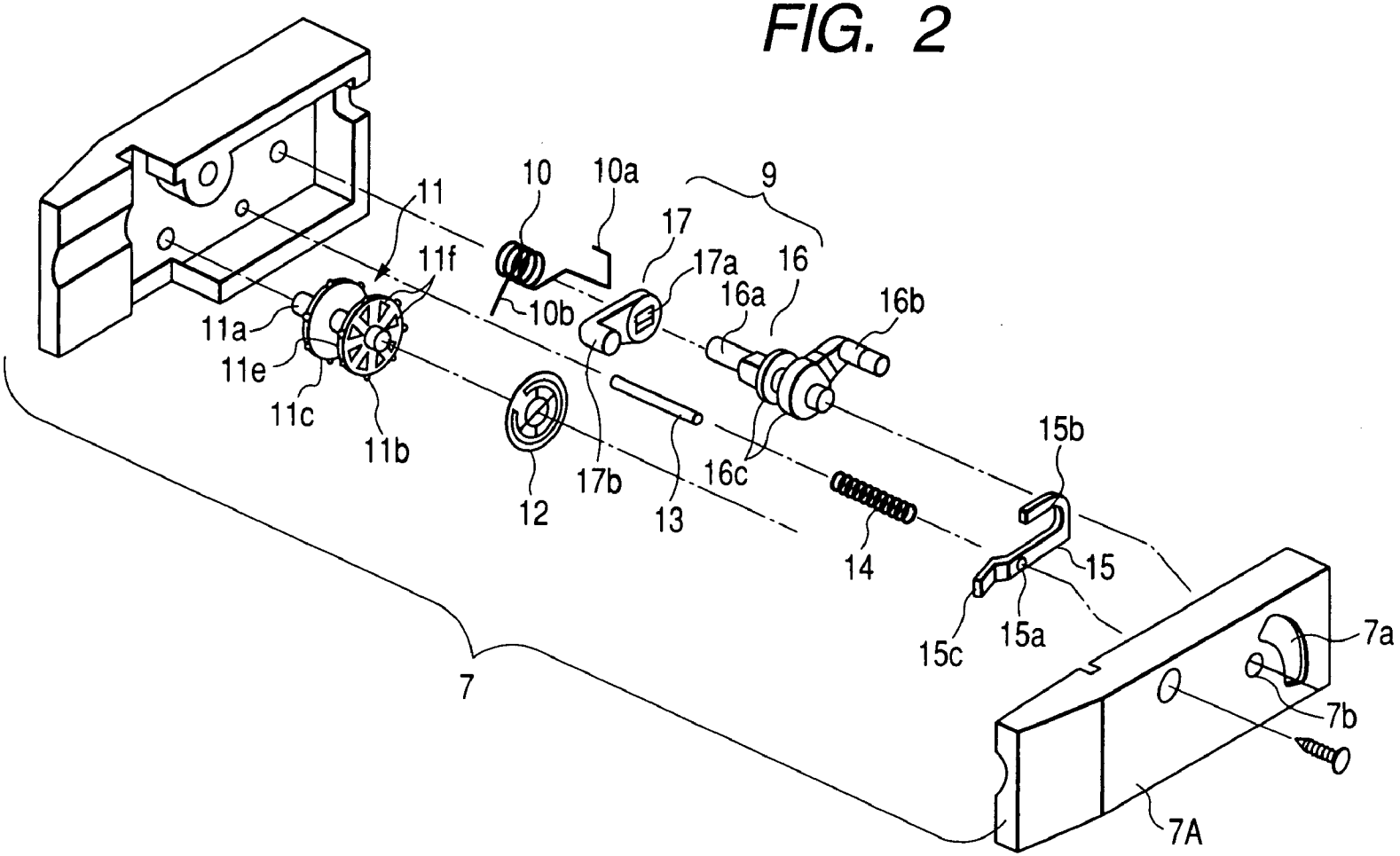
FIG. 2 is an exploded perspective view showing a screw-delivering mechanism of the screwdriver according to the invention.
Figure 3:
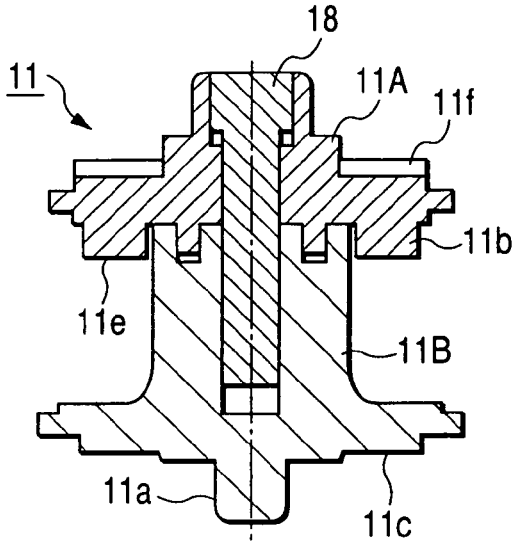
FIG. 3 is a cross-sectional view of the screwdriver according to the invention.

FIG. 1 is an exploded perspective view of a screwdriver according to the invention, FIG. 2 is an exploded perspective view of a screw-delivering mechanism of the screwdriver, FIG. 3 is a cross-sectional view of a drum, and FIGS. 4 to 8 are partial bottom cross-sectional views illustrating the operation of the screw-delivering mechanism of the screwdriver.

Figure 9:
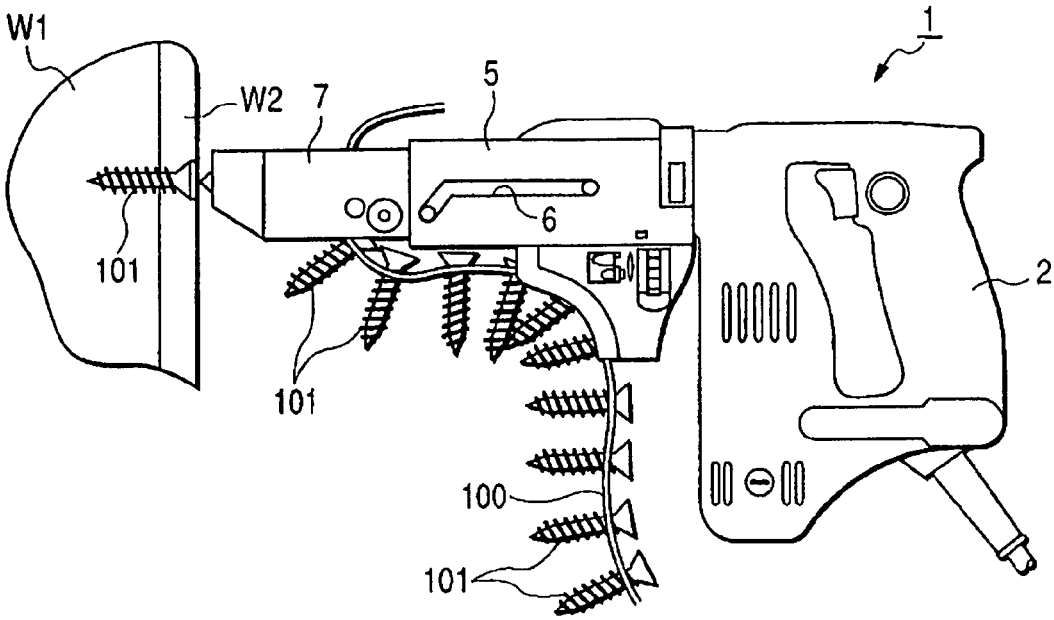
FIG. 9 PRIOR ART
FIG. 9 is cross-sectional view of a conventional screwdriver.
Figure 10:
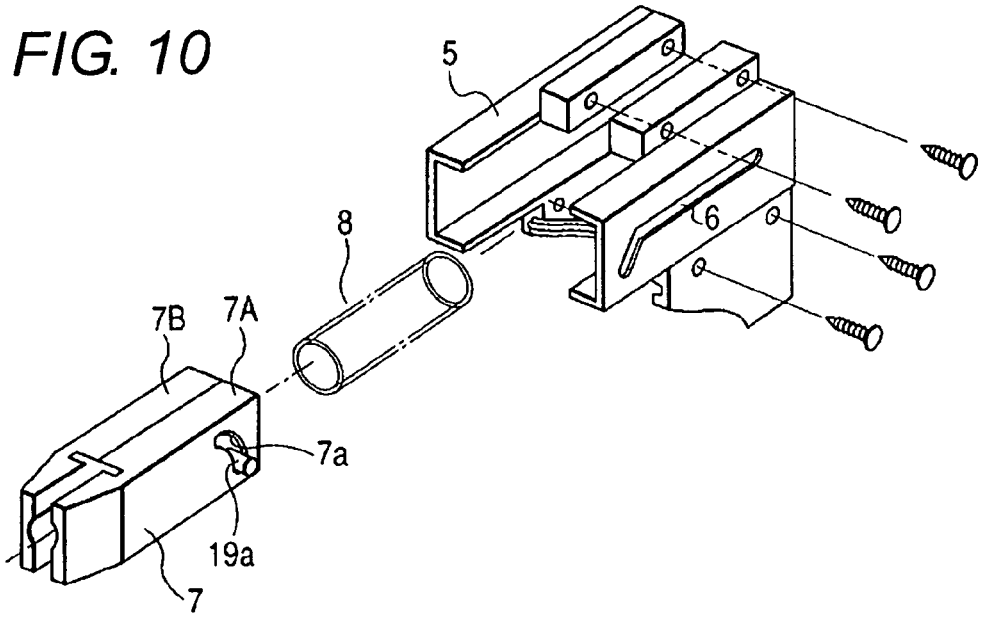
FIG. 10 is an exploded perspective view showing a screw-delivering mechanism of the conventional screwdriver.
Figure 11:
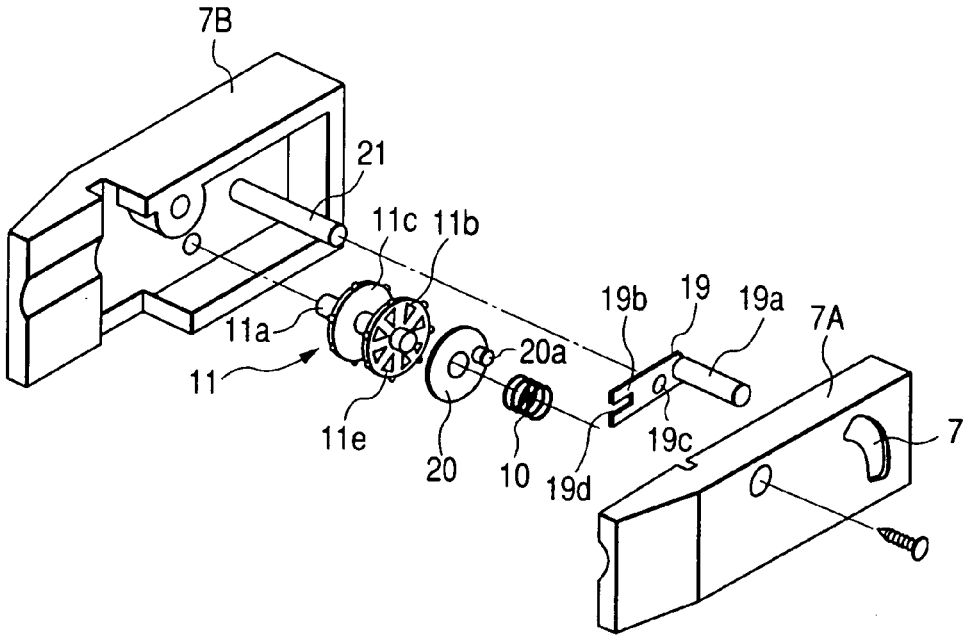
FIG. 11 is an exploded perspective view showing a slider of the conventional screwdriver.
Figure 12:
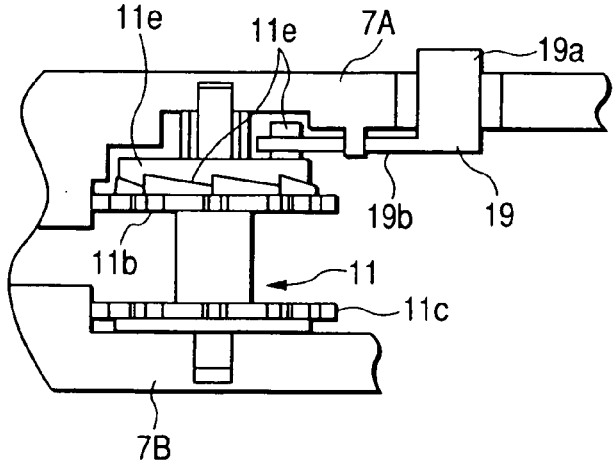
FIG. 12 is a cross-sectional view showing a clutch mechanism of the conventional screwdriver.
Figure 13:
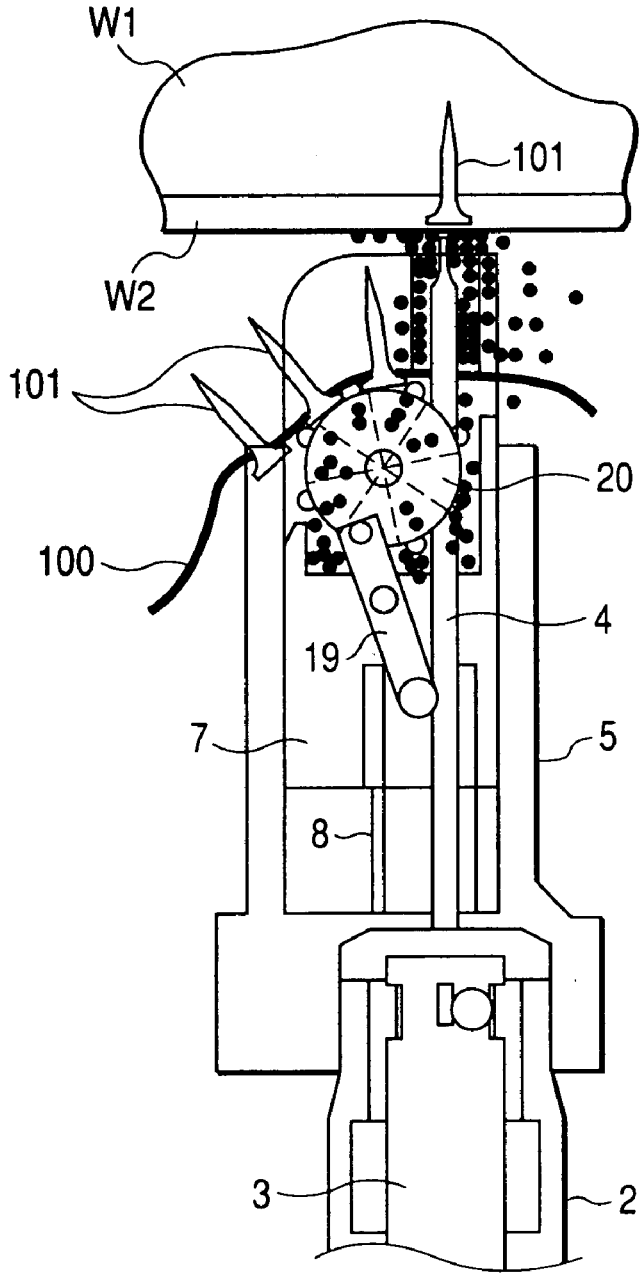
FIG. 13 is a partial cross-sectional view illustrating threaded fastening using the conventional screwdriver.

The screwdriver 1 according to the present embodiment has the same configuration as the conventional screwdriver shown in FIG. 9 except for a screw-chain mechanism. Therefore, the screw-chain mechanism will be described below.

In the screwdriver 1 according to the invention, as shown in FIG. 1, a guide slot 6 substantially formed in an L-shape is provided at one side of a slider case 5. A slider 7 is fitted in the slider case 5 and capable of sliding therein.

As shown in FIGS. 1 and 2, the slider 7 is formed by assembling left and right parts 7A and 7B, which accommodates an arm portion 9, a coil spring 10 serving as first and third elastic members, a drum 11, a leaf spring 12, a shaft 13, a coil spring 14 as a second elastic member, and a stopper plate 15. A circular-arc guide slot 7*a* is formed at one part 7A of the slider 7.

The arm portion 9 consists of a shaft arm 16 and a clutch arm 17. The shaft arm 16 has a shaft 16*a* that is supported in the slider 7 to be capable of rotating about another axis parallel to a rotating shaft 11*a* of the drum 11 and a guide arm 16*b* that extends from the shaft 16*a* beyond the guide slot 7*a* of the slider 7. One end of the guide arm 16*b* is fitted in the guide slot 7*a*.

The clutch arm 17 extends from the shaft 16*a* of the shaft arm 16 to the drum 11. The shaft 16*a* of the shaft arm 16 is inserted and fitted in a rectangular hole 17*a* formed at one end of the clutch arm 17 so as not to rotate relative to the hole 17*a*. The other end of the clutch arm 17 extends to the drum 11 and has a pin-shaped engaging protrusion 17*b*.

The drum 11 is a cylindrical member that is supported and capable of rotating in the slider 7, and two disc-shaped flanges 11*b* and 11*c* are provided to the rotating shaft 11*a* at a predetermined space in an axial direction of the rotating shaft. A plurality of teeth lid are formed on the circumference of each of the flanges 11*b* and 11*c*, and engaged with the screw chain belt (100) tape shown in FIG. 9. Further, as shown in FIG. 9, several screws 101 are held by the screw chain belt 100 at predetermined intervals, and several engaging holes (not shown) to be engaged with the teeth lid on the circumferences of both flanges 11*b* and 11*c* of the drum 11 are formed at both edges in the width direction of the screw chain belt 100 so as to be longitudinally arranged at predetermined pitches.

A ratchet 11*e* is formed on an inner surface (the surface facing the other flange 11*c*) of one flange 11*b* of the drum 11 (see FIG. 4), and several engaging grooves 11*f* are formed on the outer surface (the opposite surface to the inner surface having the ratchet 11*e*) of the flange 11*b*. The corrugated leaf spring 12 fixed to the inside of the slider 7 (the part 7A) is engaged with the flange 11*b* through the engaging grooves 11*f*.

As shown in FIG. 3, the drum 11 is formed by combining two parts 11A and 11B, which are axially separable, using a bolt 18. One part 11A is made of a metal such as SUS and the other part 11B is made of a resin. The ratchet 11*e* is formed on an inner surface of the flange 11*b* of the metal part 11A.

The stopper plate 15 formed in an L-shape extends from the shaft 16*a* of the shaft arm 16 to the ratchet 11*e* of the drum 11, and is supported by the shaft 13 at its middle and capable of oscillating in the slider 7. The shaft 13 is positioned between the drum 11 and the shaft arm 16 and held between the two parts 7A and 7B of the slider 7. The stopper plate 15 is supported by the shaft 13 inserted in a hole 15*a* formed through the stopper plate 15 and capable of rotating.

One end 15*b* of the stopper plate 15 has a key shape and connected to the shaft 16*a* by being fitted between both flange-like portions 16*c* provided to the shaft 16*a* of the shaft arm 16. The other end thereof functions as an engaging portion 15*c* that is engaged with or disengaged from the ratchet 11*e* formed on the flange 11*b* of the drum 11. The stopper plate 15 is pushed in an axial direction (that is, in a direction in which the engaging portion 15*c* is engaged with the ratchet 11*e* of the drum 11) by the coil spring 14 into which the shaft 13 is inserted.

The clutch arm 17 extends from the shaft 16*a* of the shaft arm 16 to the ratchet 11*e* of the drum 11 and is pushed in one direction together with the shaft arm 16 by a coil spring 10 into which the shaft 16*a* is inserted. An engaging protrusion 17*b* formed at an end of the clutch arm 17 is pressed against the ratchet 11*e* and engaged with it. A U-shaped one end 10*a* of the coil spring 10 is locked to the guide arm 16*b* of the shaft arm 16 and the other end 10*b* thereof is locked to the part 7B of the slider 7. Accordingly, as described above, the coil spring 10 functions as a third elastic member that pushes the shaft arm 16 and the clutch arm 17 in the axial direction, and further a first elastic member that pushes the shaft arm 16 such that the guide arm 16*b* is held in the guide slot 7*a* of the slider 7 due to torsion.

Figure 4:
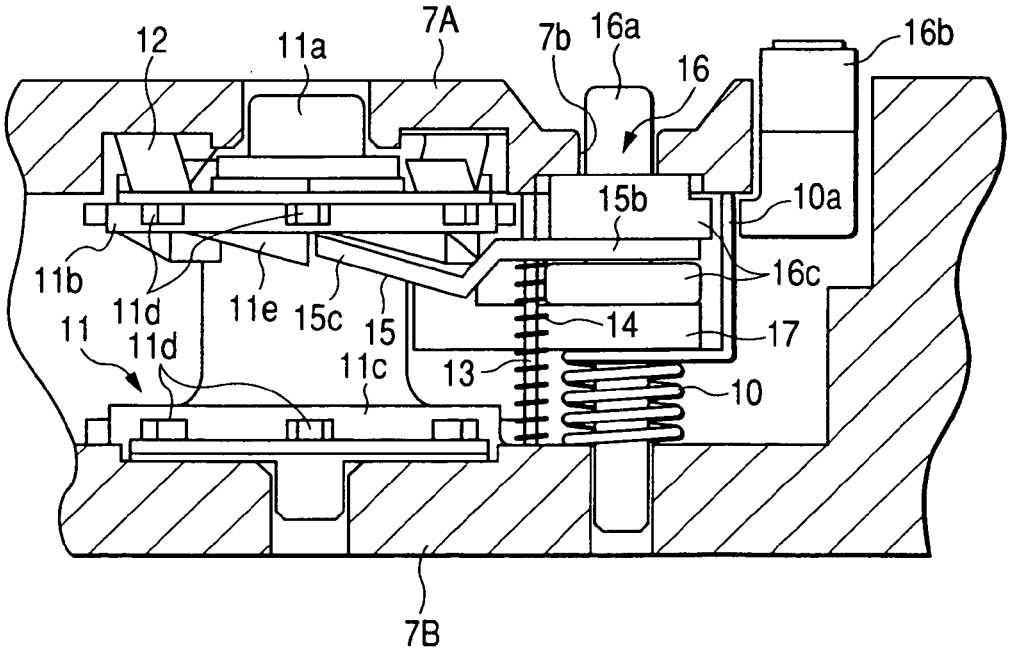
FIG. 4 is a partial cross-sectional view illustrating operation (at initial condition) of the screw-delivering mechanism of the screwdriver according to the invention.

Further, as shown in FIG. 4, an end of the guide arm 16*b* of the shaft arm 16 protrudes outward from the guide slot 7*a* formed on the part 7A of the slider 7.

The operation of the screwdriver 1 configured as described above will be described below.

Figure 5:
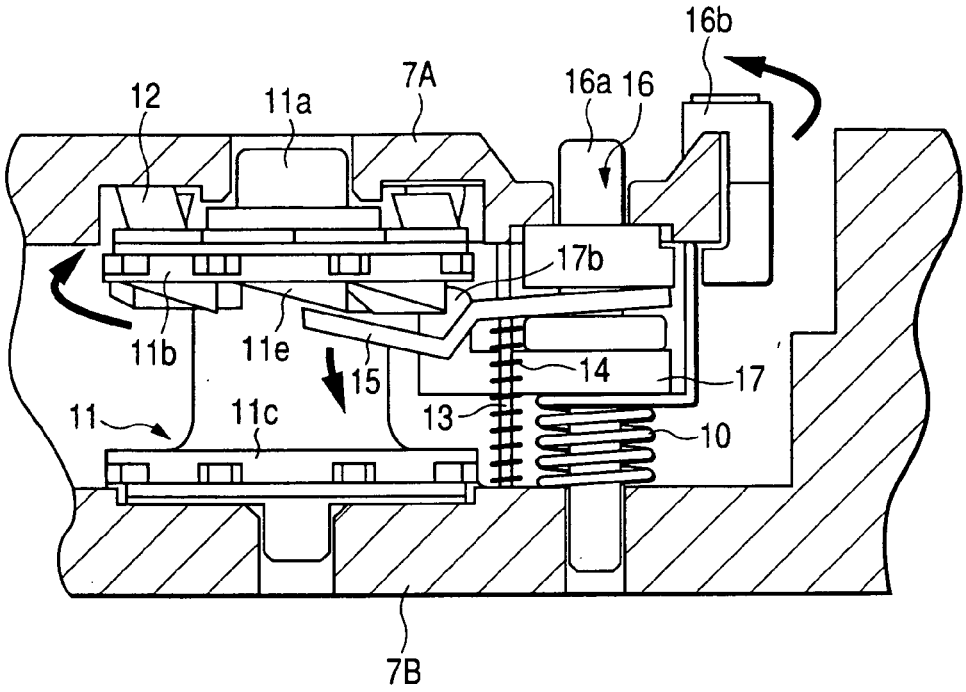
FIG. 5 is a partial cross-sectional view illustrating operation (delivering of screws) of the screw-delivering mechanism of the screwdriver according to the invention.

For example, in fixing a gypsum board W2 to a base material W1 using screws as shown in FIG. 9, when the screwdriver 1 in initial condition shown in FIG. 4 is pressed against the gypsum board W2, the slider 7 is pushed into the slider case 5 against the reacting force of a coil spring 8 and the shaft arm 16 rotates about the shaft 16*a* as shown in FIG. 5.

In other words, since the guide arm 16*b* of the shaft arm 16 supported in the slider 7 slides along the guide slot 7*a* of the slider case 5, the shaft arm 16 rotates at a predetermined angle in a direction indicated by an arrow in FIG. 5 and the clutch arm 17 fitted to the shaft 16*a* also rotates at the same angle in the direction. As the clutch arm 17 rotates, the drum 11 having the ratchet 11*e* engaged with the engaging protrusion 17*b* of the clutch arm 17 rotates in a direction indicated by an arrow in FIG. 5 and the chain belt 100 engaged with the flanges 11*b* and 11*c* of the drum 11 is intermittently delivered at a predetermined distance, therefore, the screws 101 held by the screw chain belt 100 are delivered one-by-one (see FIG. 9). Further, the stopper plate 15 oscillates by the ratchet 11*e* of the drum 11 in a direction indicated by an arrow in FIG. 5 and allows the drum 11 to rotate.

Figure 6:
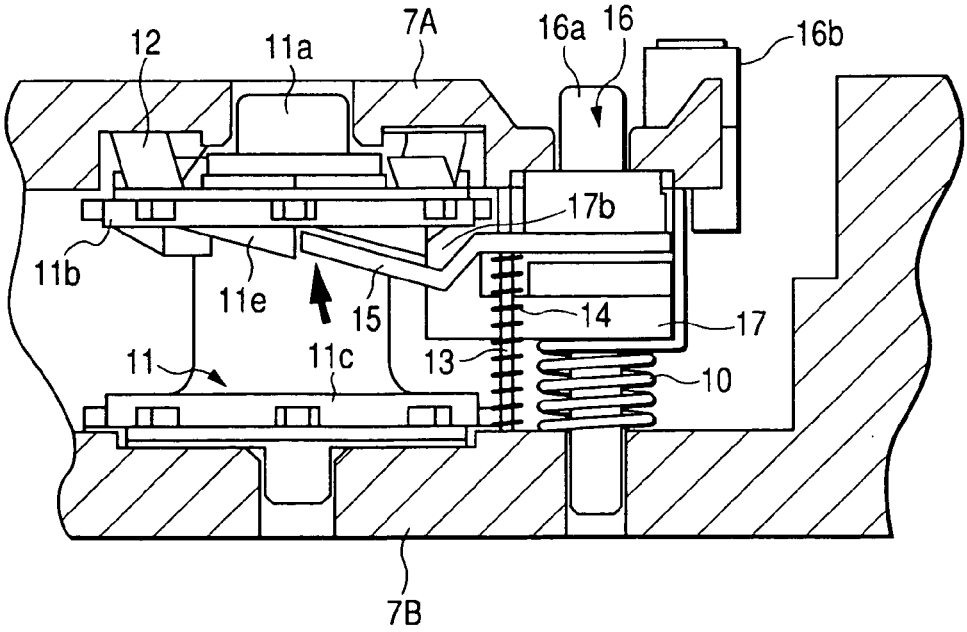
FIG. 6 is a partial cross-sectional view illustrating operation (completing the delivering of screws) of the screw-delivering mechanism of the screwdriver according to the invention.

When the screws 101 are delivered as described above, a screw 101 positioned on the axis of the bit 4 of the driver portion is launched out of the screw chain belt 100 and driven into the gypsum board W2 by the bit 4, and the screw 101 fastens the gypsum board W2 to the base material W1 by the bit 4 rotated by a motor (not shown). In this case, as shown in FIG. 6, the engaging portion 15*c* of the stopper plate 15 is engaged with the ratchet 11*e* of the drum 11 and prevents reverse rotation of the drum 11.

Figure 7:
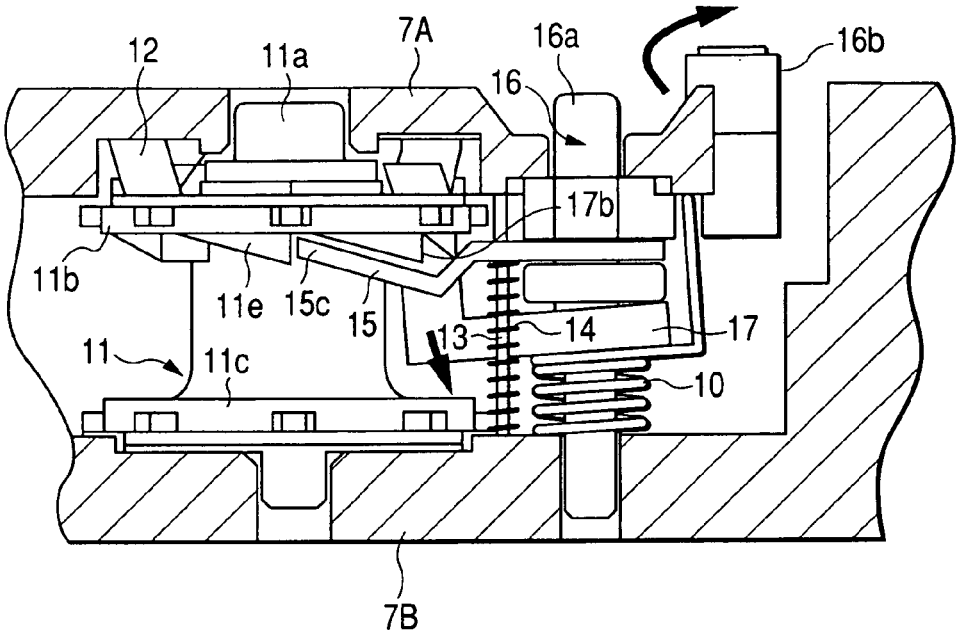
FIG. 7 is a partial cross-sectional view illustrating operation (returning to the initial condition) of the screw-delivering mechanism of the screwdriver according to the invention.

As the screwdriver 1 is detached from the gypsum board W2, the slider 7 slides and returns to the initial position by the reacting force of the coil spring 8 in the slider case 5, whereby the shaft arm 16 and the clutch arm 17 reverse as shown in FIG. 7. However, the reverse rotation is not transmitted to the drum 11, thus the screw chain belt 100 and the screws 101 are not delivered. Additionally, the engaging portion 15*c* of the stopper plate 15 is engaged with the ratchet 11*e* of the drum 11 and prevents the reverse rotation of the drum 11, and the clutch arm 17 oscillates in a direction indicated by an arrow in FIG. 7 as the engaging protrusion 17*b* moves by the ratchet 11*e* of the drum 11. As a result, since the clutch arm 17 is disengaged from the ratchet 11*e*, the reverse rotation is not transmitted to the drum 11.

By repetition of the above operation, the screw chain belt 100 is delivered by one pitch, and the screws 101 held through the screw chain belt 100 are sequentially delivered one-by-one. Accordingly, the gypsum board W2 may be fastened to the base material W1 by several screws.

Since the distance between the two flanges 11*b* and 11*c* of the drum 11 is determined to correspond to the width of the screw chain belt 100, a relatively wide space is defined between the flanges 11*b* and 11*c*. However, in this embodiment, the most vulnerable portion to particles in the screwdriver, that is, the engaging surface of the ratchet 11*e* and the engaging protrusion 17*b* of the clutch arm 17 is disposed in the wide space between the flanges 11*b* and 11*c* because the ratchet 11*e* is formed on the inner surface of the flange 11*b* of the drum 11. Accordingly, particles are not easily caught between the ratchet 11*e* and the clutch arm 17. Even if particles are caught, it is possible to easily remove the particles by cleaning. For this reason, the operational stability of the screwdriver 1 may be improved.

Since the part of the arm portion 9 engaged with the ratchet 11*e* is composed of the clutch arm 17 extending from a shaft that is spaced from the drum 11 to the ratchet 11*e*, the entire ratchet 11*e* is not engaged with the clutch arm 17 and a part of the ratchet 11*e* is not engaged. Therefore, even if particles are caught between the ratchet 11*e* and the clutch arm 17, the particles are promptly discharged outside as the clutch arm 17 is disengaged with the ratchet 11*e*. As a result, the screwdriver 1 may constantly operate regardless of particles and have further improved operational stability.

Even though the arm portion 9 does not smoothly operate due to particles in the screw-delivering mechanism, the guide arm 16*b* of the shaft arm 16 has been pushed by the coil spring 10 to be held in the guide slot 7*a* of the slider 7. Therefore, the guide arm 16*b* is constantly held in the guide slot 7*a* while the slider 7 reciprocates. Accordingly, the screw delivering does not stop due to separation of the guide arm 16*b* from the guide slot 7*a*, and the screwdriver 1 may have further high operational stability.

Figure 8:
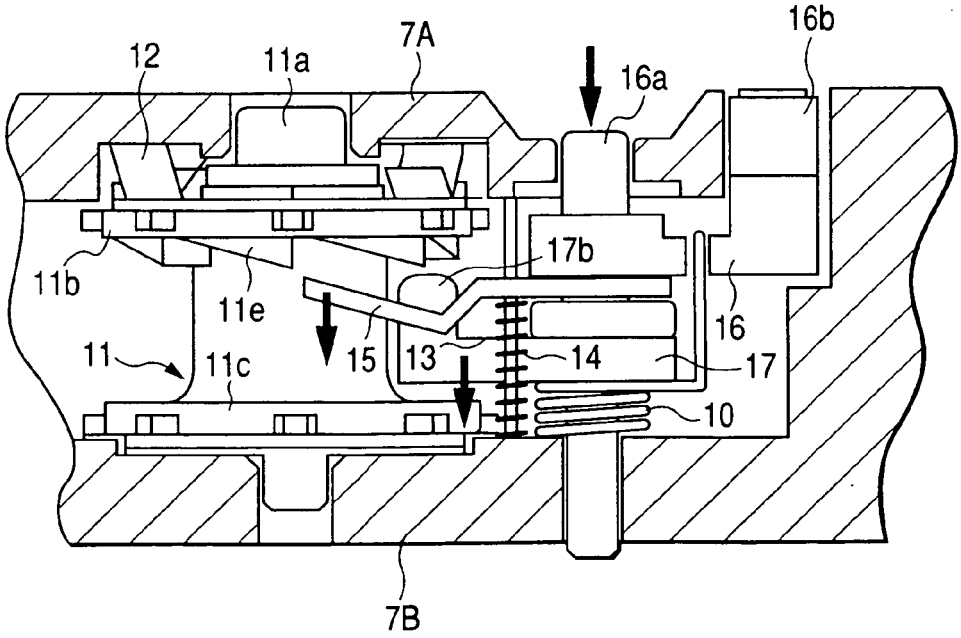
FIG. 8 is a partial cross-sectional view illustrating operation (reverse rotation of a drum) of the screw-delivering mechanism of the screwdriver according to the invention.

As shown in FIG. 8, when the guide arm 16*b* of the shaft arm 16 is pressed against the reacting force of the coil spring 10 and the shaft arm 16 moves in an axial direction (a direction indicated by an arrow in FIG. 8), the clutch arm 17 and the stopper plate 15 also move in the same direction and are disengaged from the ratchet 11*e*. Accordingly, the drum 11 can rotate in a delivering direction of the screw chain belt 100 and in a reverse direction thereof. Therefore, when excessively delivered, the screw chain belt 100 can return in the reverse direction. As a result, the operational characteristic of the screwdriver 1 is improved.

In the screwdriver 1 according to the present embodiment, since the coil spring 10 has two functions (a function to push the shaft arm 16 and the clutch arm 17 in an axial direction and a function to push the shaft arm 16 in the rotational direction), the number of parts and cost can be reduced.

Further, in the present embodiment, since the drum 11 is separated into two parts in the axial direction, each of the parts 11A and 11B is independently formed and assembled later. Thus, the drum 11 may be manufactured in a complicated shape including the flange 11*b* having the ratchet 11*e* on the inner surface thereof.

What is claimed is:

1. A screwdriver comprising:

a driver portion that includes a motor;

an output shaft rotated by the motor;

a housing accommodating the motor and the output shaft, and a bit fitted at the end of the output shaft;

a barrel-shaped slider case fixed to the housing so as to insert the bit, the barrel shaped slider comprising a guide slot;

a slider supported in the slider case, the slider capable of reciprocating;

an arm portion rotatably supported in the slider; the arm portion engaged with the guide slot of the slider case, and the arm portion oscillating in accordance with the reciprocation of the slider; and a cylindrical drum rotatably supported in the slider, the cylindrical drum intermittently delivering the screw chain belt in accordance with oscillation of the arm portion, and the cylindrical drum comprising;

two flanges engaged with a screw chain belt; and a ratchet engaged with the arm portion, wherein the ratchet of the drum is formed on an inner surface of one flange facing the other flange.

2. The screwdriver according to claim 1, wherein the arm portion comprises;

a shaft arm comprising;

a shaft rotatably supported in the slider, and the shaft capable of rotating about an axis parallel to a rotating shaft of the drum, and a guide arm extending from the shaft beyond the guide slot of the slider, and the guide arm having one end fitted in the guide slot;

a clutch arm extending from the shaft of the shaft arm to the drum, and the clutch arm comprising; one end engaged with the ratchet; and the other end unrotatably fitted to the shaft of the shaft arm relative to the shaft, and the other end capable of releasing an engagement of both the one end and the ratchet; and a first elastic member pushing the clutch arm to engage the one end of the clutch arm and the ratchet with each other.

3. The screwdriver according to claim 2, wherein the first elastic member is a coil spring in which the shaft of the shaft arm is inserted, wherein the first elastic member has one end locked to the guide arm of the shaft arm and the other end locked to the slider, and wherein the first elastic member presses the guide arm of the shaft arm to be held in the guide slot of the slider.

4. The screwdriver according to claim 2, wherein the slider further comprises:

a stopper plate extending from the shaft of the shaft arm to the ratchet of the drum, the stopper plate comprising one end engaged with the ratchet and the other end connected to the shaft such that the one end is disengaged from the ratchet;

a second elastic member pushing the stopper plate in a direction in which the one end is engaged with the ratchet; and a third elastic member supporting the shaft arm so that the shaft arm reciprocates in an axial direction of the slide, and for pushing the shaft arm toward one side in the axial direction, and wherein, when the shaft arm moves in the axial direction against a reacting force of the third elastic member, the clutch arm and the stopper plate move in the same direction to be disengaged from the ratchet.

5. The screwdriver according to claim 4, wherein one coil spring into which the shaft arm is inserted functions as both the first and third elastic members.

6. The screwdriver according to claim 1, wherein the drum is formed by assembling two separated parts, the flanges are provided to the separated parts, respectively, and the ratchet is formed on an inner surface of one flange facing the other flange.

* * * * *